US006912289B2

(12) United States Patent
Vonlanthen et al.

(10) Patent No.: US 6,912,289 B2
(45) Date of Patent: Jun. 28, 2005

(54) HEARING AID AND PROCESSES FOR ADAPTIVELY PROCESSING SIGNALS THEREIN

(75) Inventors: André Vonlanthen, Waterloo (CA); Henry Luo, Waterloo (CA); Horst Arndt, Kitchener (CA)

(73) Assignee: Unitron Hearing Ltd., Kitchener (CA)

( * ) Notice: Subject to any disclaimer, the term of this patent is extended or adjusted under 35 U.S.C. 154(b) by 77 days.

(21) Appl. No.: 10/681,310

(22) Filed: Oct. 9, 2003

(65) Prior Publication Data

US 2005/0078842 A1 Apr. 14, 2005

(51) Int. Cl.[7] ..... H04R 25/00
(52) U.S. Cl. ..... 381/312; 381/320; 381/321
(58) Field of Search ..... 381/60, 312, 316, 381/317, 318, 320, 321, 83, 93, 94.2, 94.3, 313, 92

(56) References Cited

U.S. PATENT DOCUMENTS

| | | | | |
|---|---|---|---|---|
| 5,473,701 | A | 12/1995 | Cezanne et al. | |
| 5,687,241 | A | 11/1997 | Ludvigsen | |
| 6,731,767 | B1 * | 5/2004 | Blamey et al. | 381/312 |
| 2002/0191804 | A1 | 12/2002 | Luo et al. | |
| 2003/0112987 | A1 | 6/2003 | Nordqvist et al. | |

FOREIGN PATENT DOCUMENTS

| | | |
|---|---|---|
| WO | WO 01/20965 | 1/2001 |
| WO | WO 01/22790 | 1/2001 |
| WO | WO 02/32208 | 1/2002 |

OTHER PUBLICATIONS

U.S. Appl. No. 10/402,213, Luo et al.
Byrne, D. et al., "An International comparison of long–term average speech spectra"; JASA 96(4), Oct. 1994, pp. 2108–2120.

* cited by examiner

*Primary Examiner*—Huyen D. Le
(74) *Attorney, Agent, or Firm*—Bereskin & Parr

(57) ABSTRACT

An improved hearing aid, and processes for adaptively processing signals therein to improve the perception of desired sounds by a user thereof. In one broad aspect, the present invention relates to a process in which one or more signal processing methods are applied to frequency band signals derived from an input digital signal. The level of each frequency band signal is computed and compared to at least one plurality of threshold values to determine which signal processing schemes are to be applied. In one embodiment of the invention, each plurality of threshold values to which levels of the frequency band signals are compared, is derived from a speech-shaped spectrum. Additional measures such as amplitude modulation or a signal index may also be employed and compared to corresponding threshold values in the determination.

46 Claims, 7 Drawing Sheets

HEARING AID AND PROCESSES FOR ADAPTIVELY PROCESSING SIGNALS THEREIN

FIELD OF THE INVENTION

The present invention relates generally to hearing aids, and more particularly to hearing aids adapted to employ signal processing strategies in the processing of signals within the hearing aids.

BACKGROUND OF THE INVENTION

Hearing aid users encounter many different acoustic environments in daily life. While these environments usually contain a variety of desired sounds such as speech, music, and naturally occurring low-level sounds, they often also contain variable levels of undesirable noise.

The characteristics of such noise in a particular environment can vary widely. For example, noise may originate from one direction or from many directions. It may be steady, fluctuating, or impulsive. It may consist of single frequency tones, wind noise, traffic noise, or broadband speech babble.

Users often prefer to use hearing aids that are designed to improve the perception of desired sounds in different environments. This typically requires that the hearing aid be adapted to optimize a user's hearing in both quiet and loud surroundings. For example, in quiet, improved audibility and good speech quality are generally desired; in noise, improved signal to noise ratio, speech intelligibility and comfort are generally desired.

Many traditional hearing aids are designed with a small number of programs optimized for specific situations, but users of these hearing aids are typically required to manually select what they think is the best program for a particular environment. Once a program is manually selected by the user, a signal processing strategy associated with that program can then be used to process signals derived from sound received as input to the hearing aid.

Unfortunately, manually choosing the most appropriate program for any given environment is often a difficult task for users of such hearing aids. In particular, it can be extremely difficult for a user to reliably and quickly select an optimal program in rapidly changing acoustic environments.

The advent of digital hearing aids has made possible the development of various methods aimed at assessing acoustic environments and applying signal processing to compensate for adverse acoustic conditions. These approaches generally consist of auditory scene classification and application of appropriate signal processing schemes. Some of these approaches are known and disclosed in the references described below.

For example, International Publication No. WO 01/20965 A2 discloses a method for determining a current acoustic environment, and use of the method in a hearing aid. While the publication describes a method in which certain auditory-based characteristics are extracted from an acoustic signal, the publication does not teach what functionality is appropriate when specific auditory signal parameters are extracted.

Similarly, International Publication No. WO 01/22790 A2 discloses a method in which certain auditory signal parameters are analyzed, but does not specify which signal processing methods are appropriate for specific auditory scenes.

International Publication No. WO 02/32208 A2 also discloses a method for determining an acoustic environment, and use of the method in a hearing aid. The publication generally describes a multi-stage method, but does not describe the nature and application of extracted characteristics in detail.

U.S. Publication No. 2003/01129887 A1 describes a hearing prosthesis where level-independent properties of extracted characteristics are used to automatically classify different acoustic environments.

U.S. Pat. No. 5,687,241 discloses a multi-channel digital hearing instrument that performs continuous calculations of one or several percentile values of input signal amplitude distributions to discriminate between speech and noise in order to adjust the gain and/or frequency response of a hearing aid.

SUMMARY OF THE INVENTION

The present invention is directed to an improved hearing aid, and processes for adaptively processing signals therein to improve the perception of desired sounds by a user of the hearing aid.

In hearing aids adapted to apply one or more of a set of signal processing methods for use in processing the signals, the present invention facilitates automatic selection, activation and application of the signal processing methods to yield improved performance of the hearing aid.

In one aspect of the present invention, there is provided a process for adaptively processing signals in a hearing aid, wherein the hearing aid is adapted to apply one or more of a predefined plurality of signal processing methods to the signals, the process comprising the steps of: receiving an input digital signal, wherein the input digital signal is derived from an input acoustic signal converted from sounds received by the hearing aid; analyzing the input digital signal, wherein at least one level and at least one measure of amplitude modulation is determined from the input digital signal; for each of the plurality of signal processing methods, determining if the respective signal processing method is to be applied to the input digital signal by performing the substeps of comparing each determined level with at least one first threshold value defined for the respective signal processing method, and comparing each determined measure of amplitude modulation with at least one second threshold value defined for the respective signal processing method; and processing the input digital signal to produce an output digital signal, wherein the processing step comprises applying each signal processing method to the input digital signal as determined at the determining step.

In another aspect of the present invention, there is provided a process for adaptively processing signals in a hearing aid, wherein the hearing aid is adapted to apply one or more of a predefined plurality of signal processing methods to the signals, the process comprising the steps of: receiving an input digital signal, wherein the input digital signal is derived from an input acoustic signal converted from sounds received by the hearing aid; analyzing the input digital signal, wherein at least one level and at least one signal index value is determined from the input digital signal; for each of the plurality of signal processing methods, determining if the respective signal processing method is to be applied to the input digital signal by performing the substeps of comparing each determined level with at least one first threshold value defined for the respective signal processing method, and comparing each determined signal index value with at least one second threshold value defined for the respective signal processing method; and processing the input digital signal to produce an output digital signal, wherein the processing step comprises applying each signal processing method to the input digital signal as determined at the determining step.

In another aspect of the present invention, there is provided a process for adaptively processing signals in a hearing aid, wherein the hearing aid is adapted to apply one or more of a predefined plurality of signal processing methods to the signals, the process comprising the steps of: receiving an input digital signal, wherein the input digital signal is derived from an input acoustic signal converted from sounds received by the hearing aid; analyzing the input digital signal, wherein the input digital signal is separated into a plurality of frequency,band signals, and wherein a level for each frequency band signal is determined; for each of a subset of said plurality of signal processing methods, comparing the level for each frequency band signal with a corresponding threshold value from each of at least one plurality of threshold values defined for the respective signal processing method of the subset, wherein each plurality of threshold values is associated with a processing mode of the respective signal processing method of the subset, to determine if the respective signal processing method is to be applied to the input digital signal in a respective processing mode thereof; and processing the input digital signal to produce an output digital signal, wherein the processing step comprises applying each signal processing method of the subset to the frequency band signals of the input digital signal as determined at the determining step, and recombining the frequency band signals to produce the output digital signal.

In another aspect of the present invention, the hearing aid is adapted to apply adaptive microphone directional processing to the frequency band signals.

In another aspect of the present invention, the hearing aid is adapted to apply adaptive wind noise management processing to the frequency band signals, in which adaptive noise reduction is applied to frequency band signals when low level wind noise is detected, and in which adaptive maximum output reduction is applied to frequency band signals when high level wind noise is detected.

In another aspect of the present invention, multiple pluralities of threshold values associated with various processing modes of a signal processing method are also defined in the hearing aid, for use in determining whether a particular signal processing method is to be applied to an input digital signal, and in which processing mode.

In another aspect of the present invention, at least one plurality of threshold values is derived in part from a speech-shaped spectrum.

In another aspect of the present invention, the application of signal processing methods to an input digital signal is performed in accordance with a hard switching or soft switching transition scheme.

In another aspect of the present invention, there is provided a digital hearing aid comprising a processing core programmed to perform a process for adaptively processing signals in accordance with an embodiment of the invention.

BRIEF DESCRIPTION OF THE DRAWINGS

These and other features of the present invention will be made apparent from the following description of embodiments of the invention, with reference to the accompanying drawings, in which.

DETAILED DESCRIPTION OF PREFERRED EMBODIMENTS

The present invention is directed to an improved hearing aid, and processes for adaptively processing signals therein to improve the perception of desired sounds by a user of the hearing aid.

In a preferred embodiment of the invention, the hearing aid is adapted to use calculated average input levels in conjunction with one or more modulation or temporal signal parameters to develop threshold values for enabling one or more of a specified set of signal processing methods, such that the hearing aid user's ability to function more effectively in different sound situations can be improved.

Figure 1:
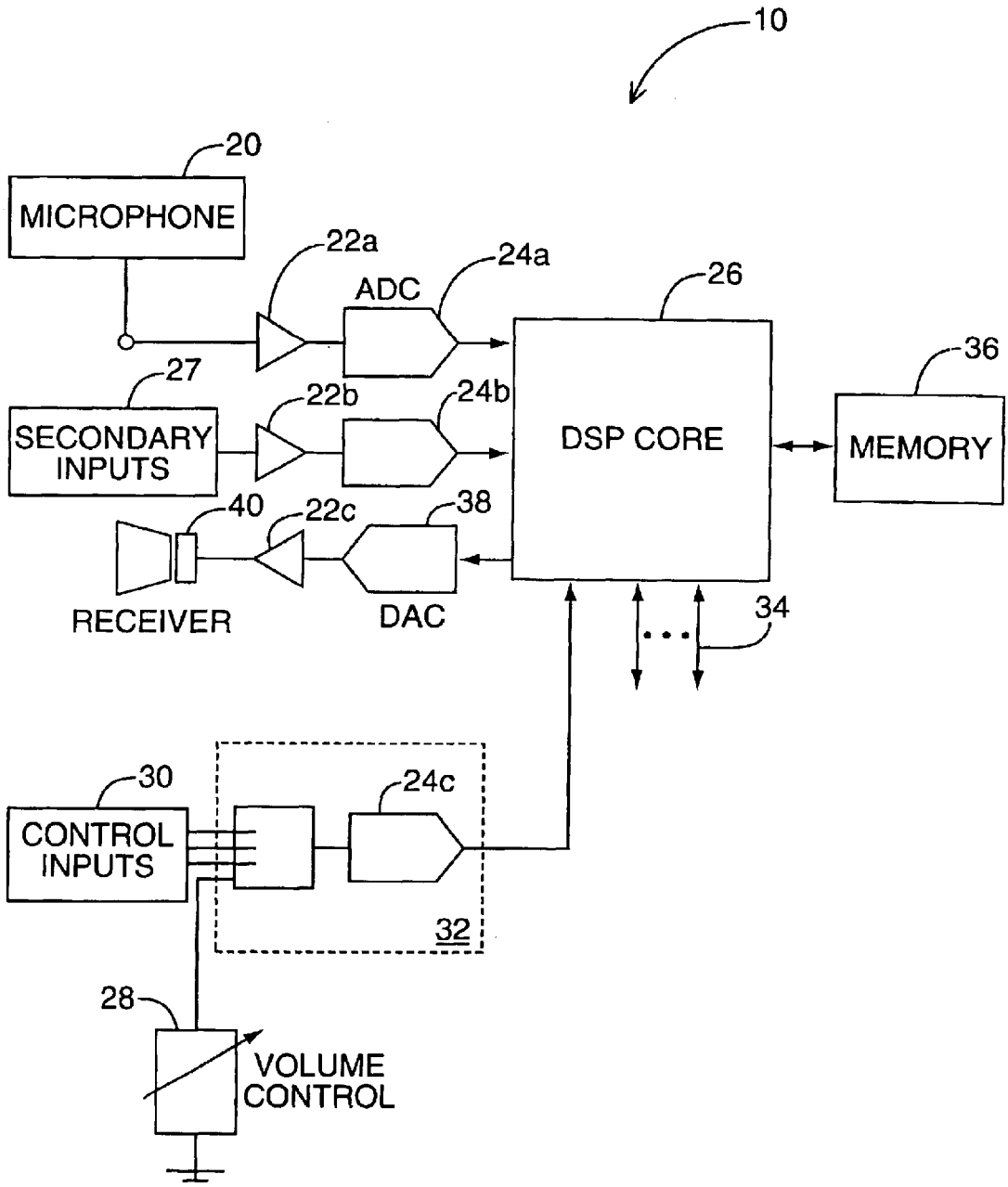
FIG. 1 is a schematic diagram illustrating components of a hearing aid in one example implementation of the invention.

Referring to FIG. 1, a schematic diagram illustrating components of a hearing aid in one example implementation of the present invention is shown generally as 10. It will be understood by persons skilled in the art that the components of hearing aid 10 as illustrated are provided by way of example only, and that hearing aids in implementations of the present invention may comprise different and/or additional components.

Hearing aid 10 is a digital hearing aid that includes an electronic module, which comprises a number of components that collectively act to receive sounds or secondary input signals (e.g. magnetic signals) and process them so that the sounds can be better heard by the user of hearing aid 10. These components are powered by a power source, such as a battery stored in a battery compartment [not shown] of hearing aid 10. In the processing of received sounds, the sounds are typically amplified for output to the user.

Hearing aid 10 includes one or more microphones 20 for receiving sound and converting the sound to an analog, input acoustic signal. The input acoustic signal is passed through an input amplifier 22*a* to an analog-to-digital converter (ADC) 24*a*, which converts the input acoustic signal to an input digital signal for further processing. The input digital signal is then passed to a programmable digital signal processing (DSP) core 26. Other secondary inputs 27 may also be received by core 26 through an input amplifier 22*b*, and where the secondary inputs 27 are analog, through an ADC 24*b*. The secondary inputs 27 may include a telecoil circuit [not shown] which provides core 26 with a telecoil input signal. In still other embodiments, the telecoil circuit may replace microphone 20 and serve as a primary signal source.

Hearing aid 10 may also include a volume control 28, which is operable by the user within a range of volume positions. A signal associated with the current setting or position of volume control 28 is passed to core 26 through a low-speed ADC 24*c*. Hearing aid 10 may also provide for other control inputs 30 that can be multiplexed with signals from volume control 28 using multiplexer 32.

All signal processing is accomplished digitally in hearing aid 10 through core 26. Digital signal processing generally facilitates complex processing, which often cannot be implemented in analog hearing aids. In accordance with the present invention, core 26 is programmed to perform steps of a process for adaptively processing signals in accordance with an embodiment of the invention, as described in greater detail below. Adjustments to hearing aid 10 may be made digitally by hooking it up to a computer, for example, through external port interfaces 34. Hearing aid 10 also comprises a memory 36 to store data and instructions, which are used to process signals or to otherwise facilitate the operations of hearing aid 10.

In operation, core 26 is programmed to process the input digital signals according to a number of signal processing methods or techniques, and to produce an output digital signal. The output digital signal is converted to an output acoustic signal by a digital-to-analog converter (DAC) 38, which is then transmitted through an output amplifier 22*c*to a receiver 40 for delivering the output acoustic signal as sound to the user. Alternatively, the output digital signal may drive a suitable receiver [not shown] directly, to produce an analog output signal.

The present invention is directed to an improved hearing aid and processes for adaptively processing signals therein, to improve the auditory perception of desired sounds by a user of the hearing aid. Any acoustic environment in which auditory perception occurs can be defined as an auditory scene. The present invention is based generally on the concept of auditory scene adaptation, which is a multi-environment classification and processing strategy that organizes sounds according to perceptual criteria for the purpose of optimizing the understanding, enjoyment or comfort of desired acoustic events.

In contrast to multi-program hearing aids that offer a number of discrete programs, each associated with a particular signal processing strategy or method or combination of these, and between which a hearing aid user must manually select to best deal with a particular auditory scene, hearing aids developed based on auditory scene adaptation technology are designed with the intention of having the hearing aid make the selections. Ideally, the hearing aid will identify a particular auditory scene based on specified criteria, and select and switch to one or more appropriate signal processing strategies to achieve optimal speech understanding and comfort for the user.

Hearing aids adapted to automatically switch among different signal processing strategies or methods and to apply them offer several significant advantages. For example, a hearing aid user is not required to decide which specific signal processing strategies or methods will yield improved performance. This may be particularly beneficial for busy people, young children, or users with poor dexterity. The hearing aid can also utilize a variety of different processing strategies in a variety of combinations, to provide greater flexibility and choice in dealing with a wide range of acoustic environments. This built-in flexibility may also benefit hearing aid fitters, as less time may be required to adjust the hearing aid.

Automatic switching without user intervention, however, requires a hearing aid instrument that is capable of diverse and sophisticated analysis. While it might be feasible to build hearing aids that offer some form of automatic switching functionality at varying levels, the relative performance and efficacy of these hearing aids will depend on certain factors. These factors may include, for example, when the hearing aid will switch between different signal processing methods, the manner in which such switches are made, and the specific signal processing methods that are available for use by the hearing aid. Distinguishing between different acoustic environments can be a difficult task for a hearing aid, especially for music or speech. Precisely selecting the right program to meet a particular user's needs at any given time requires extensive detailed testing and verification.

In Table 1 shown below, a number of common listening environments or auditory scenes, are shown along with typical average signal input levels and amounts of amplitude modulation or fluctuation of the input signals that a hearing aid might expect to receive in those environments.

TABLE 1

Characteristics of Common Listening Environments

| Listening Environment | Average Level (dB SPL) | Fluctuation/Band |
|---|---|---|
| Quiet | <50 | Low |
| Speech in Quiet | 65 | High |
| Noise | >70 | Low |
| Speech in Noise | 70–80 | Medium |
| Music | 40–90 | High |
| High Level Noise | 90–120 | Medium |
| Telephone | 65 | High |

In one embodiment of the present invention, four different primary adaptive signal processing methods are defined for use by the hearing aid, and the best processing method or combination of processing methods to achieve optimal comfort and understanding of desired sounds for the user is applied. These signal processing methods include adaptive microphone directionality, adaptive noise reduction, adaptive real-time feedback cancellation, and adaptive wind noise management. Other basic signal processing methods (e.g. low level expansion for quiet input levels, broadband wide-dynamic range compression for music) are also employed in addition to the adaptive signal processing methods. The adaptive signal processing methods will now be described in greater detail.

Adaptive Microphone Directionality

Microphone directivity describes how the sensitivity of a microphone of the hearing aid (e.g. microphone 20 of FIG. 1) depends on the direction of incoming sound. An omni-directional microphone ("omni") has the same sensitivity in all directions, which is preferred in quiet situations. With directional microphones ("dir"), the sensitivity varies as a function of direction. Since the listener (i.e. the user of the hearing aid) is usually facing in the direction of the source of desired sound, directional microphones are generally configured to have maximum sensitivity to the front, with sensitivity to sound coming from the sides or the rear being reduced.

Figure 2:
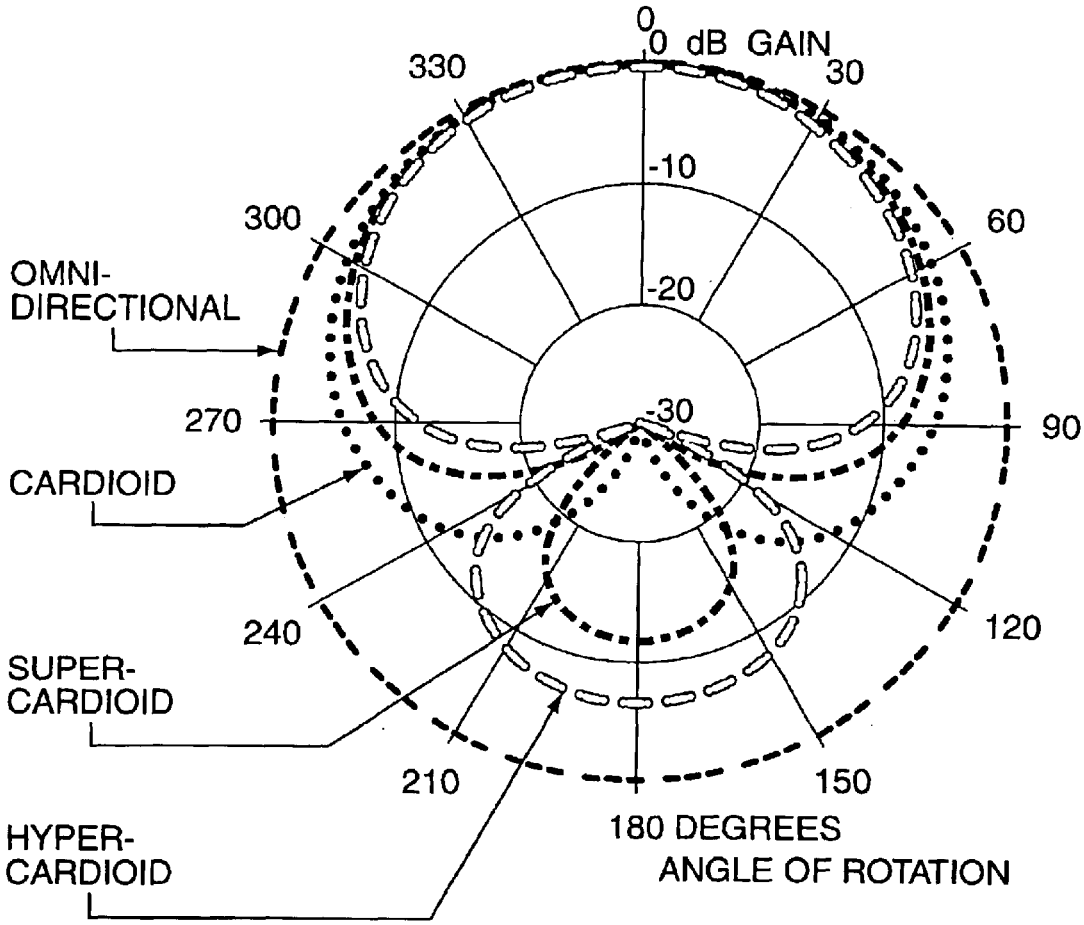
FIG. 2 is a graph illustrating examples of directional patterns that can be associated with directional microphones of hearing aids.

Three directional microphone patterns are often used in hearing aids: cardioid, super-cardioid, and hyper-cardioid. These directional patterns are illustrated in FIG. 2. Referring to FIG. 2, it is clear that once the sound source moves away from the frontal direction (0° azimuth), the sensitivity decreases for all three directional microphones. These directional microphones work to improve signal-to-noise ratio in relation to their overall directivity index (DI) and the location of the noise sources. In general terms, the DI is a measure of the advantage in sensitivity (in dB) the microphone gives to sound coming directly from the front of the microphone, compared to sounds coming from all other directions.

For example, a cardioid pattern will provide a DI in the neighbourhood of 4.8 dB. Since the null for a cardioid microphone is at the rear (180° azimuth), the microphone will provide maximum attenuation to signals arriving from the rear. In contrast, a super-cardioid microphone has a DI of approximately 5.7 dB and nulls in the vicinity of 130° and 230° azimuth, while a hyper-cardioid microphone has a DI of 6.0 dB and nulls in the vicinity of 110° and 250° azimuth.

Each directional pattern is considered optimal for different situations. They are useful in diffuse fields, reverberant rooms, and party environments, for example, and can also effectively reduce interference from stationary noise sources that coincide with their respective nulls. However, their ability to attenuate sounds from moving noise sources is not optimal, as they typically have fixed directional patterns. For example, single capsule directional microphones produce fixed directional patterns. Any of the three directional patterns can also be produced by processing the output from two spatially separated omni-directional microphones using, for example, different delay-and-add strategies. Adaptive directional patterns are produced by applying different processing strategies over time.

Adaptive directional microphones continuously monitor the direction of incoming sounds from other than the frontal direction, and are adapted to modify their directional pattern so that the location of the nulls adapt to the direction of a moving noise source. In this way, adaptive microphone directionality may be implemented to continuously maximize the loudness of the desired signal in the present of both stationary and moving noise sources.

For example, one application employing adaptive microphone directionality is described in U.S. Pat. No. 5,473,701, the contents of which are herein incorporated by reference. Another approach is to switch between a number of specific directivity patterns such as omni-directional, cardioid, super-cardioid, and hyper-cardioid patterns.

A multi-channel implementation for directional processing may also be employed, where each of a number of channels or frequency bands is processed using a processing technique specific to that frequency band. For example, omni-directional processing may be applied in some frequency bands, while cardioid processing is applied in others.

Other known adaptive directionality processing techniques may also be used in implementations of the present invention.

Adaptive Noise Reduction

A noise canceller is used to apply a noise reduction algorithm to input signals. The effectiveness of a noise reduction algorithm depends primarily on the design of the signal detection system. The most effective methods examine several dimensions of the signal simultaneously. For example, one application employing adaptive noise reduction is described in co-pending U.S. Pat. Application No. 10/101,598, the contents of which are herein incorporated by reference. The hearing aid analyzes separate frequency bands along 3 different dimensions (e.g. amplitude modulation, modulation frequency, and time duration of the signal in each band) to obtain a signal index, which can then be used to classify signals into different noise or desired signal categories.

Other known adaptive noise reduction techniques may also be used in implementations of the present invention.

Adaptive Real-time Feedback Cancellation

Acoustic feedback does not occur instantaneously. Acoustic feedback is instead the result of a transition over time from a stable acoustic condition to a steady-state saturated condition. The transition to instability begins when a change in the acoustic path between the hearing aid output and input results in a loop gain greater than unity. This may be characterized as the first stage of feedback—a growth in output, but not yet audible. The second stage may be characterized by an increasing growth in output that eventually becomes audible, while at the third stage, output is saturated and is audible as a continuous, loud and annoying tone.

One application employing adaptive real-time feedback cancellation is described in co-pending U.S. patent application Ser. No. 10/402,213, the contents of which are herein incorporated by reference. The real-time feedback canceller used therein is designed to sense the first stage of feedback, and thereby eliminate feedback before it becomes audible. Moreover, a single feedback path or multiple feedback paths can have several feedback peaks. The real-time feedback canceller is adaptive as it is adapted to eliminate multiple feedback peaks at different frequencies at any time and at any stage during the feedback buildup process. This technique is extremely effective for vented ear molds or shells, particularly when the listener is using a telephone.

The adaptive feedback canceller can be active in each of a number of channels or frequency bands. A feedback signal can be eliminated in one or more channels without significantly affecting sound quality. In addition to working in precise frequency regions, the activation time of the feedback canceller is very rapid and thereby suppresses feedback at the instant when feedback is first sensed to be building up.

Other known adaptive feedback cancellation techniques may also be used in implementations of the present invention.

Adaptive Wind Noise Management

Wind causes troublesome performance in hearing aids. Light winds cause only low-level noise and this may be dealt with adequately by a noise canceller. However, a more troublesome situation occurs when strong winds create sufficiently high input pressures at the hearing aid microphone to saturate the microphone's output. This results in loud pops and bands that are difficult to eliminate.

One technique to deal with such situations is to limit the output of the hearing aid to reduce output in affected bands and minimize the effects of the high-level noise. The amount of maximum output reduction to be applied is dependent on the level of the input signal in the affected bands.

A general feature of wind noise measured with two different microphones is that the output signals from the two microphones are less correlated than for non-wind noise signals. Therefore, the presence of high-level signals with low correlation can be detected and attributed to wind, and the output limiter can be activated accordingly to reduce the maximum power output of the hearing instrument while the high wind noise condition exists.

Where only one microphone is used in the hearing instrument, the spectral pattern of the microphone signal may also be used to activate the wind noise management function. The spectral properties of wind noise are a relatively flat frequency response from frequencies up to about 1.5 kHz and about a 6 dB/octave roll-off for higher frequencies. When this spectral pattern is detected, the output limiter can be activated accordingly.

Alternatively, the signal index used in adaptive noise reduction may be combined with a measurement of the overall average input level to activate the wind noise management function. For example, noise with a long duration, low amplitude modulation and low modulation frequency would place the input signal into a "wind" category.

Other adaptive wind noise management techniques may also be used in implementations of the present invention.

Other Signal Processing Methods

Although the present invention is described herein with respect to embodiments that employ the above adaptive signal processing methods, it will be understood by persons skilled in the art that other signal processing methods may also be employed (e.g. automatic telecoil switching, adaptive compression, etc.) in variant implementations of the present invention.

Application of Signal Processing Methods

With respect to the signal processing methods identified above, different methods can be associated with different listening environments. For instance, Table 2 illustrates an example of how a number of different signal processing methods can be associated with the common listening environments depicted in Table 1.

respectively may be activated. However, for most auditory scenes in between, the hearing aid need not switch between discrete programs, but may instead increase or decrease the effect of a given signal processing method (e.g. adaptive microphone directionality, adaptive noise cancellation) by applying the method in one of a number of predefined processing modes associated with the method.

For example, when adaptive microphone directionality is to be applied (i.e. when it is not "off"), it may be applied progressively in one of three processing modes: omni-directional, a first directional mode that provides an optimally equalized low frequency response equivalent to an omni-directional response, and a second directional mode that provides an uncompensated low frequency response. Other modes may be defined in variant implementations of an adaptive hearing aid. The use of these three modes will have the effect that for low to moderate input levels, the loudness and sound quality are not reduced; at higher input levels, the directional microphone's response becomes uncompensated and the sound of the instrument is brighter with a larger auditory contrast.

TABLE 2

Signal Processing Methods Applicable to Various Listening Environments

| Listening Environment | Average Level (dB SPL) | Fluctuation/Band | Main Feature | Microphone |
|---|---|---|---|---|
| Quiet | <50 | Low | Squelch, low level expansion | Omni |
| Speech in Quiet | 65 | High | | Omni |
| Noise | >70 | Low | Noise Canceller | Dir |
| Speech in Noise | 70–80 | Medium | Noise Canceller | Dir |
| Music | 40–90 | High | Broadband WDRC | Omni |
| High Level Noise | 90–120 | Medium | Output Limiter | Dir/Mic Squelch |
| Telephone | 65 | High | Feedback Canceller | Omni |

Table 2 depicts some examples of signal processing methods that may be applied under the conditions shown. It will be understood that the values in Table 2 are provided by way of example only, and for only a few examples of common listening situations or environments. Additional levels and fluctuation categories can be defined, and the parameters for each listening environment may be varied in variant embodiments of the invention.

Figure 3:
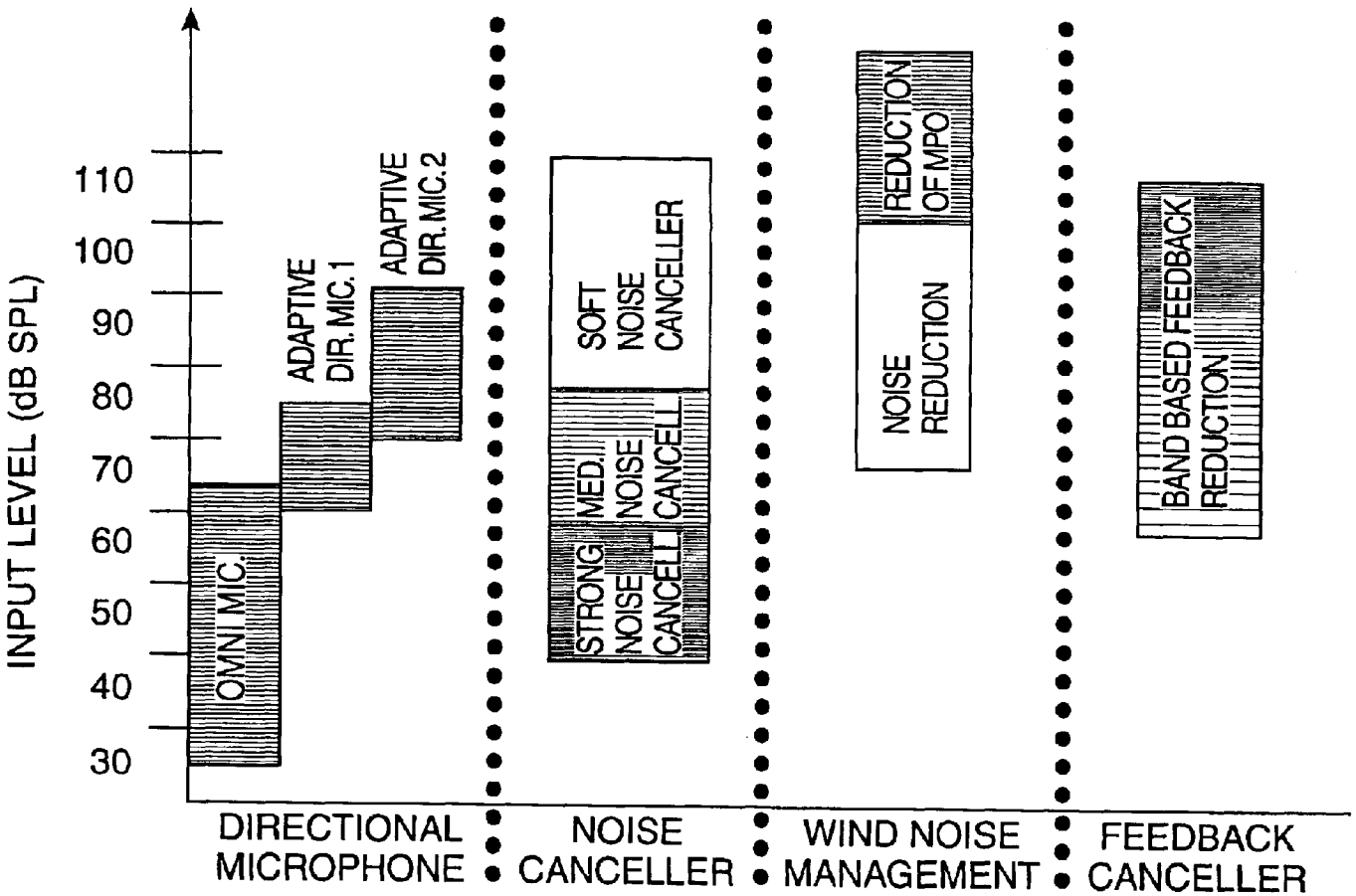
FIG. 3 is a graph illustrating how different signal processing methods can be activated at different average input levels in an embodiment of the present invention.

Referring to FIG. 3, a graph illustrating how different signal processing methods can be activated at different average input levels in an embodiment of the present invention is shown.

FIG. 3 illustrates, by way of example, that one or more signal processing methods may be activated based on the level of the input signal alone. FIG. 3 is not intended to accurately define activation levels for the different methods depicted therein; however, it can be observed from FIG. 3 that for a specific input level, several different signal processing methods may act on an input signal.

In this embodiment of the invention and other embodiments of the invention described herein, the level of the input signal that is calculated is an average signal level. The use of an average signal level will generally lead to less sporadic switching between signal processing methods and/or their processing modes. The time over which an average is determined can be optimized for a given implementation of the present invention.

In the example depicted in FIG. 3, for very quiet and very loud input levels, low level expansion and output limiting Where the hearing aid is equipped with multiple microphones, the outputs may be added to provide better noise performance in the omni-directional mode, while in the directional mode, the microphones are adaptively processed to reduce sensitivity from other directions. On the other hand, where the hearing aid is equipped with one microphone, it may be advantageous to switch between a broadband response and a different response shape.

As a further example, when adaptive noise reduction is to be applied (i.e. when it is not "off"), it may be applied in one of three processing modes: soft (small amounts of noise reduction), medium (moderate amounts of noise reduction), and strong (large amounts of noise reduction). Other modes may be defined in variant implementations of an adaptive hearing aid.

Noise reduction may be implemented in several ways. For example, a noise reduction activation level may be set at a low threshold value (e.g. 50 dB SPL), so that when this threshold value is exceeded, strong noise reduction may be activated and maintained independent of higher input levels. Alternatively, the noise reduction algorithm may be configured to progressively change the degree of noise reduction from strong to soft as the input level increases. It will be understood by persons skilled in the art that other variant implementations are possible.

With respect to both adaptive microphone directionality and adaptive noise reduction, the processing mode of each respective signal processing method to be applied is input level dependent, as shown in FIG. 3. When the input level attains an activation level or threshold value defined within the hearing aid and associated with a new processing mode, the given signal processing method may be switched to operate in the new processing mode. Accordingly, as input levels rise for different listening environments, the different processing modes of adaptive microphone directionality and adaptive noise reduction are applied.

Furthermore, when input levels become extreme, output reduction by the output limiter, as controlled by the adaptive wind noise management algorithm will be engaged. Low-level wind noise can be handled using the noise reduction algorithm.

As shown in FIG. 3, when feedback is detected, feedback cancellation can also be engaged.

As previously indicated, it will be understood by persons skilled in the art that FIG. 3 is not intended to provide precise or exclusive threshold values, and that other threshold values are possible.

In accordance with the present invention, the hearing aid is programmed to apply one or more of a set of signal processing methods defined within the hearing aid. The core may utilize information associated with the defined signal processing methods stored in a memory or storage device. In one example implementation, the set of signal processing methods comprises four adaptive signal processing methods: adaptive microphone directionality, adaptive noise reduction, adaptive feedback cancellation, and adaptive wind noise management. Additional and/or other signal processing methods may also be used, and hearing aids in which a set of signal processing methods have previously been defined may be reprogrammed to incorporate additional and/or other signal processing methods.

Although it is feasible to apply each signal processing method (in a given processing mode) consistently across the entirety of a wide range of frequencies (i.e. broadband), in accordance with an embodiment of the present invention described below, at least one of the signal processing methods used to process signals in the hearing aid is applied at the frequency band level.

In one embodiment of the present invention, threshold values to which average input levels are compared are derived from a speech-shaped spectrum.

Figure 4A:
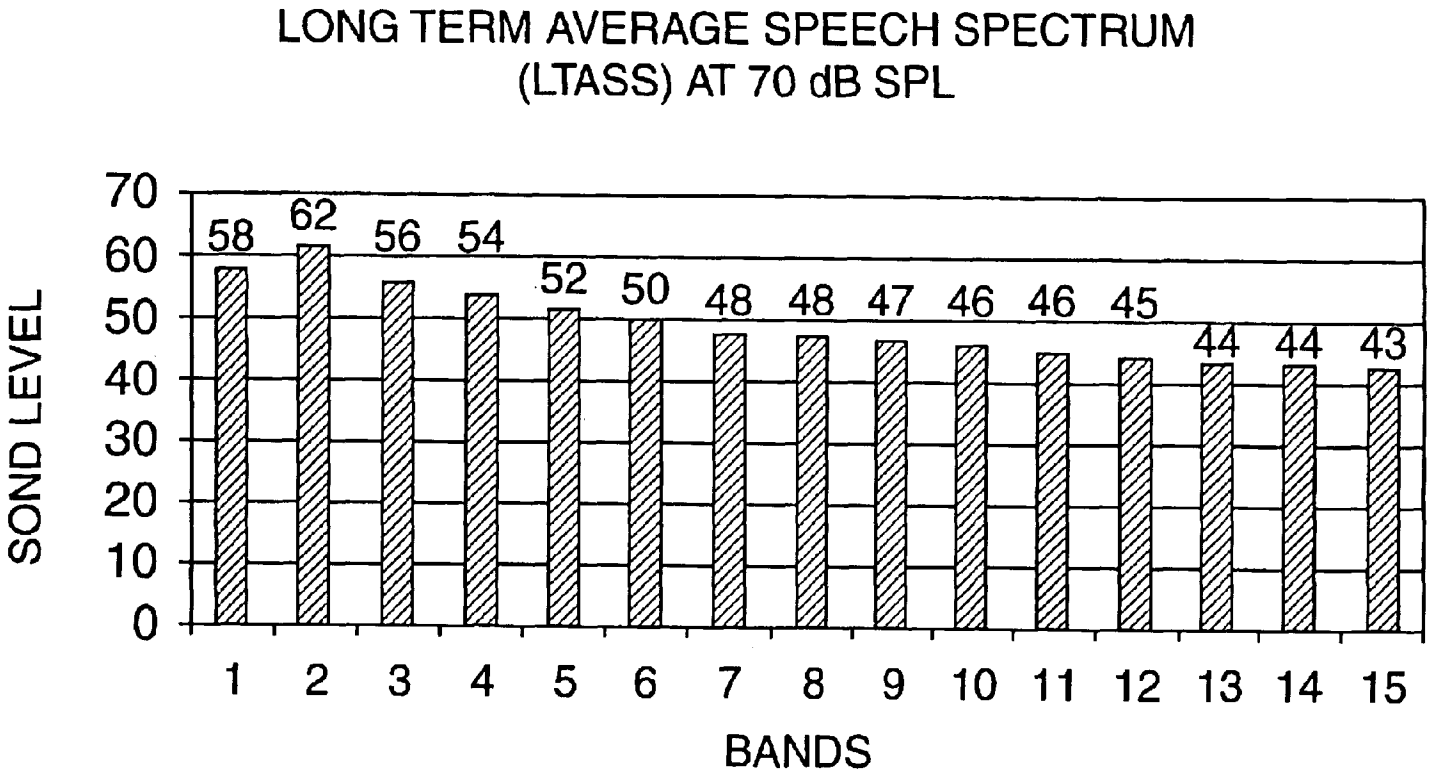
FIG. 4A is a graph that illustrates per-band signal levels of a long-term average spectrum of speech normalized at an overall level of 70 dB SPL.
Figure 4B:
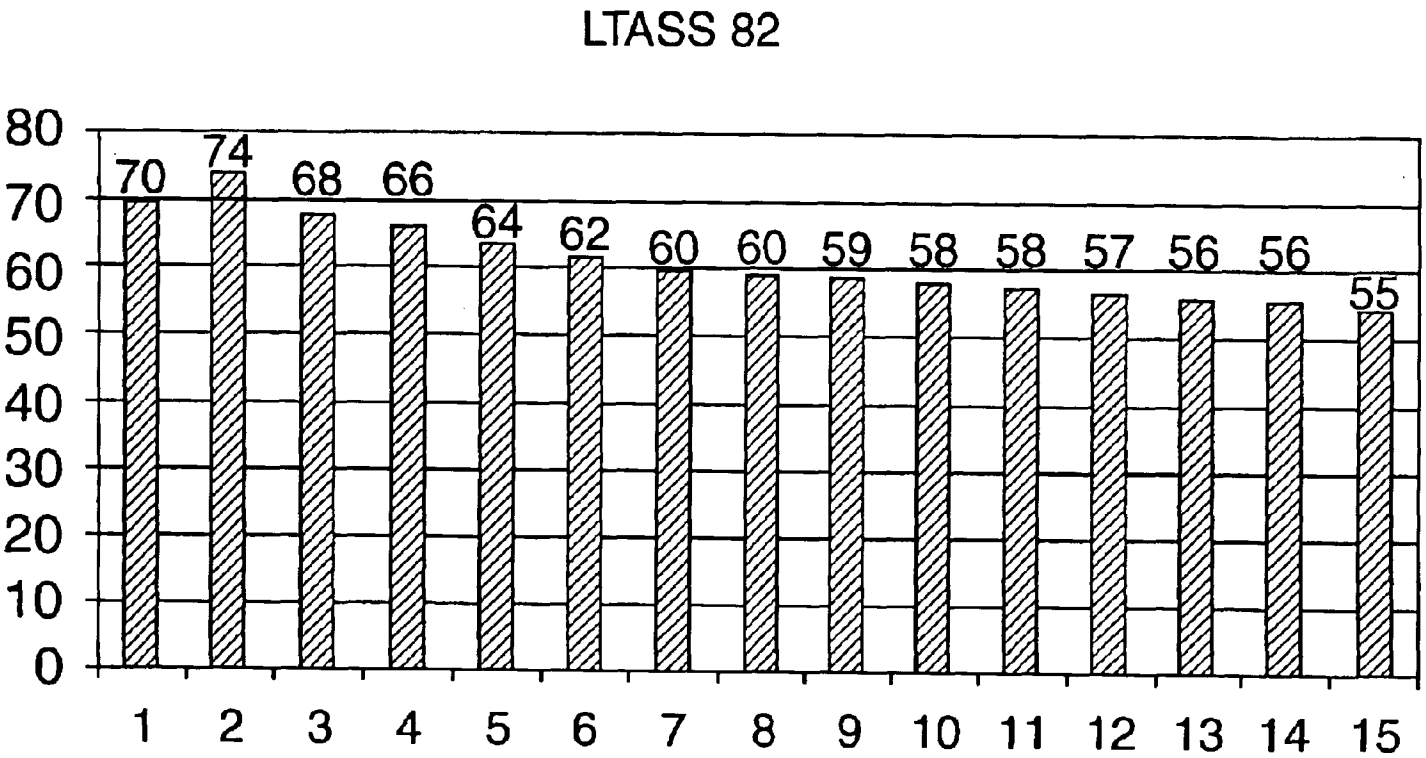
FIG. 4B is a graph that illustrates per-band signal levels of a long-term average spectrum of speech normalized at an overall level of 82 dB SPL.
Figure 4C:
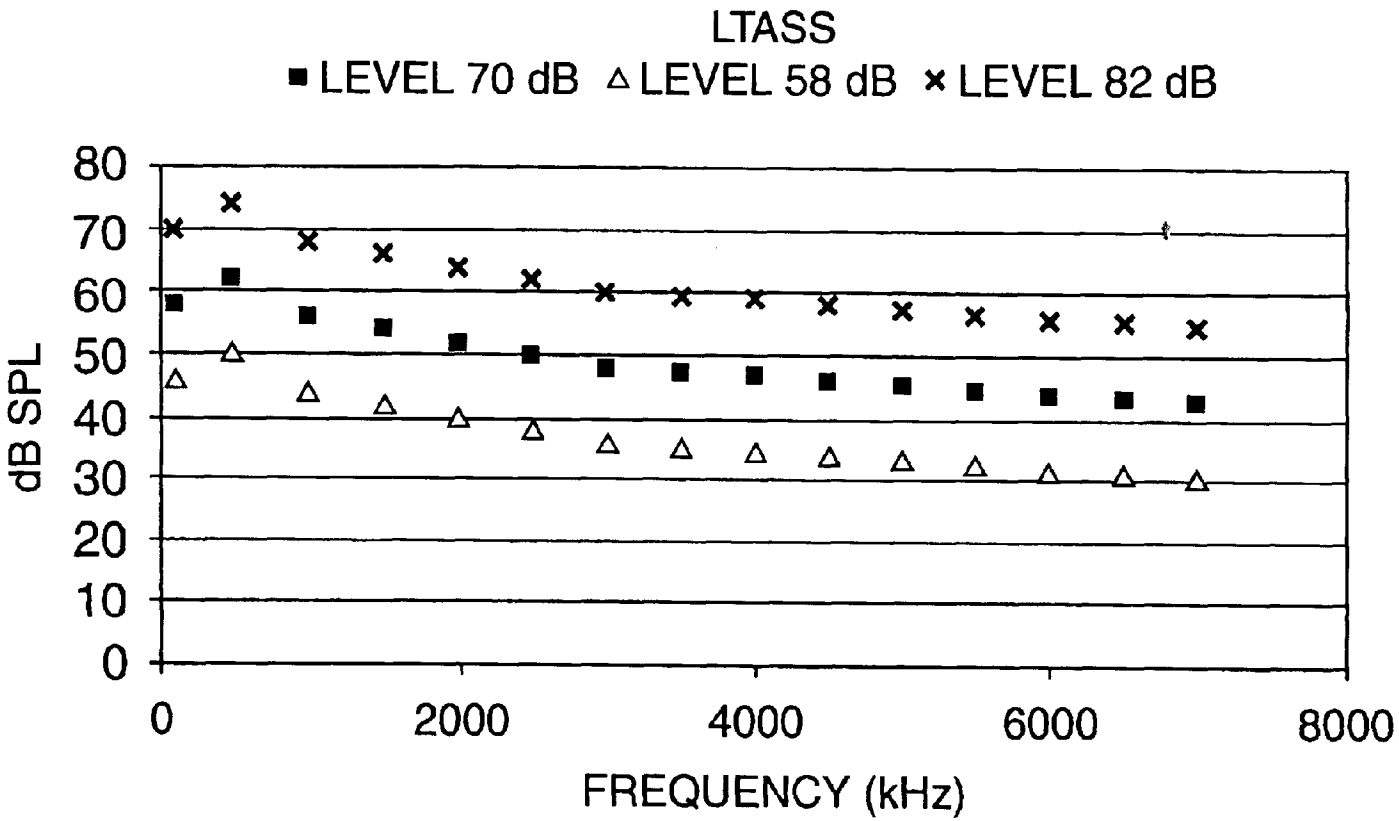
FIG. 4C is a graph that collectively illustrates per-band signal levels of a long-term average spectrum of speech normalized at three different levels of speech-shaped noise.

Referring to FIGS. 4*a* to 4*c*, graphs that illustrates per-band signal levels of the long-term average spectrum of speech normalized at different overall levels are shown.

In one embodiment of the present invention, a speech-shaped spectrum of noise is used to derive one or more sets of threshold values to which levels of the input signal can be compared, which can then be used to determine when a particular signal processing method, or particular processing mode of a signal processing method if multiple processing modes are associated with the signal processing method, is to be activated and applied.

In one implementation of this embodiment of the invention, a long-term average spectrum of speech ("LTASS") described by Byrne et al., in JASA 96(4), 1994, pp. 2108–2120, the contents of which are herein incorporated by reference), and normalized at various overall levels, is used to derive sets of threshold values for signal processing methods to be applied at the frequency band level.

For example, FIG. 4*a* illustrates the individual signal levels in 500 Hz bands for the LTASS, normalized at an overall level of 70 dB Sound Pressure Level (SPL). It can be observed that the per-band signal levels are frequency specific, and the contribution of each band to the overall SPL of the speech-shaped noise is illustrated in FIG. 4*a*. Similarly, FIG. 4*b* illustrates the individual signal levels for the LTASS, normalized at an overall level of 82 dB SPL. FIG. 4*c* illustrates comparatively the individual signal levels (shown on a frequency scale) for the LTASS, normalized at overall levels of 58 dB, 70 dB and 82 dB SPL respectively. In this embodiment of the invention, each set of threshold values associated with a processing mode of a signal processing method is derived from LTASS normalized at one of these levels.

In order to obtain the sets of threshold values in this embodiment of the invention, the spectral shape of the 70 dB SPL LTASS was scaled up or down to determine LTASS at 58 dB and 82 dB SPL.

In this embodiment of the invention, a speech-shaped spectrum is used as it is readily available, since speech is usually an input to the hearing aid. Basing the threshold values at which signal processing methods (or modes thereof) are activated on the long-term average speech spectrum, facilitates the preservation of the processed speech as much as possible.

However, it will be understood by persons skilled in the art that in variant embodiments of the invention, sets of threshold values can be derived from LTASS using different frequency band widths, or derived from other speech-shaped spectra, or other spectra.

It will also be understood by persons skilled in the art, that variations of the LTASS may alternatively be employed in variant embodiments of the invention. For instance, LTASS normalized at different overall levels may be employed. LTASS may also be varied in subtle ways to accommodate specific language requirements, for example. For any particular signal processing method, the LTASS from which threshold values are derived may need to be modified for input signals of different vocal intensities (e.g. as in the Speech Transmission Index), or weighted by the frequency importance function of the Articulation Index, for example, as may be determined empirically.

In FIGS. 4*a* and *b*, the value above each bar shows the average signal level within each frequency band for a 70 dB SPL and 82 dB SPL LTASS respectively. FIG. 4*c* shows the average signal levels within each frequency band (500 Hz wide) for 82, 70 and 58 dB SPL LTASS. Overall LTASS values or individual band levels can be used as threshold values for different signal processing strategies.

For example, using threshold values derived from the LTASS shown in FIG. 4*a*, the activation and application of adaptive microphone directionality can be controlled in an embodiment of the invention. Whenever the input signal in a particular frequency band exceeds the corresponding threshold value shown, the microphone in that particular band will operate in a first directional mode; any frequency band with an input signal level below that threshold value will remain omni-directional. At this moderate signal level above the threshold value, the low frequency roll-off typically associated with the directional microphone is optimized for loudness in this first directional mode, so that sound quality will not be reduced. Below the threshold value, both microphones (assuming 2 microphones) produce an overall omni-directional response but they are running simultaneously to provide best noise performance. Adaptive directionality is engaged in this way.

Similarly, whenever the input signal in a particular frequency band exceeds the corresponding level shown in FIG. 4*b*, the microphone in that particular band will switch to operate in a second directional mode. In this second directional mode, the low frequency roll-off will no longer be compensated, and the hearing aid will provide a brighter sound quality while providing greater auditory contrast.

In this example, the microphone of the hearing aid can operate in at least two different directional modes characterized by two sets of gains in the low frequency bands. Alternatively, the gains can vary gradually with input level between these two extremes.

As a further example, using threshold values derived from the LTASS shown in FIG. 4*c*, the activation and application of adaptive noise reduction can be controlled in an embodiment of the invention. This signal processing method is also controlled by the band level, and in one particular embodiment of the invention, all bands are independent of one another. The detectors of a level-dependent noise canceller implementing this signal processing method can vary its performance characteristics from strong to soft noise reduction by referencing the LTASS over time.

In one embodiment of the present invention, a fitter of the hearing aid (or user of the hearing aid) can set a maximum threshold value for the noise canceller (or turn the noise canceller "off"), associated with different noise reduction modes as follows:

i. off (no noise reduction effect);

ii. soft (maximum threshold=82 dB SPL);

iii. medium (maximum threshold=70 dB SPL); and iv. strong (maximum threshold=58 dB SPL).

The maximum threshold values indicated above are provided by way of example only, and may different in variant embodiments of the invention.

As explained earlier, in this embodiment, each noise reduction mode defines the maximum available reduction due to the noise canceller within each band. For example, choosing a high maximum threshold (e.g. 82 dB SPL LTASS), will cause the noise canceller to adapt only in channels with high input levels when the corresponding threshold value derived from the corresponding spectrum is reached, and low level signals would be relatively unaffected. On the other hand, setting the maximum threshold lower (e.g. 58 dB SPL LTASS), the canceller will also adapt at much lower input levels, thereby providing a much stronger noise reduction effect.

In another embodiment of the invention, the hearing aid may be configured to progressively change the amount of noise cancellation as the input level increases.

Figure 5:
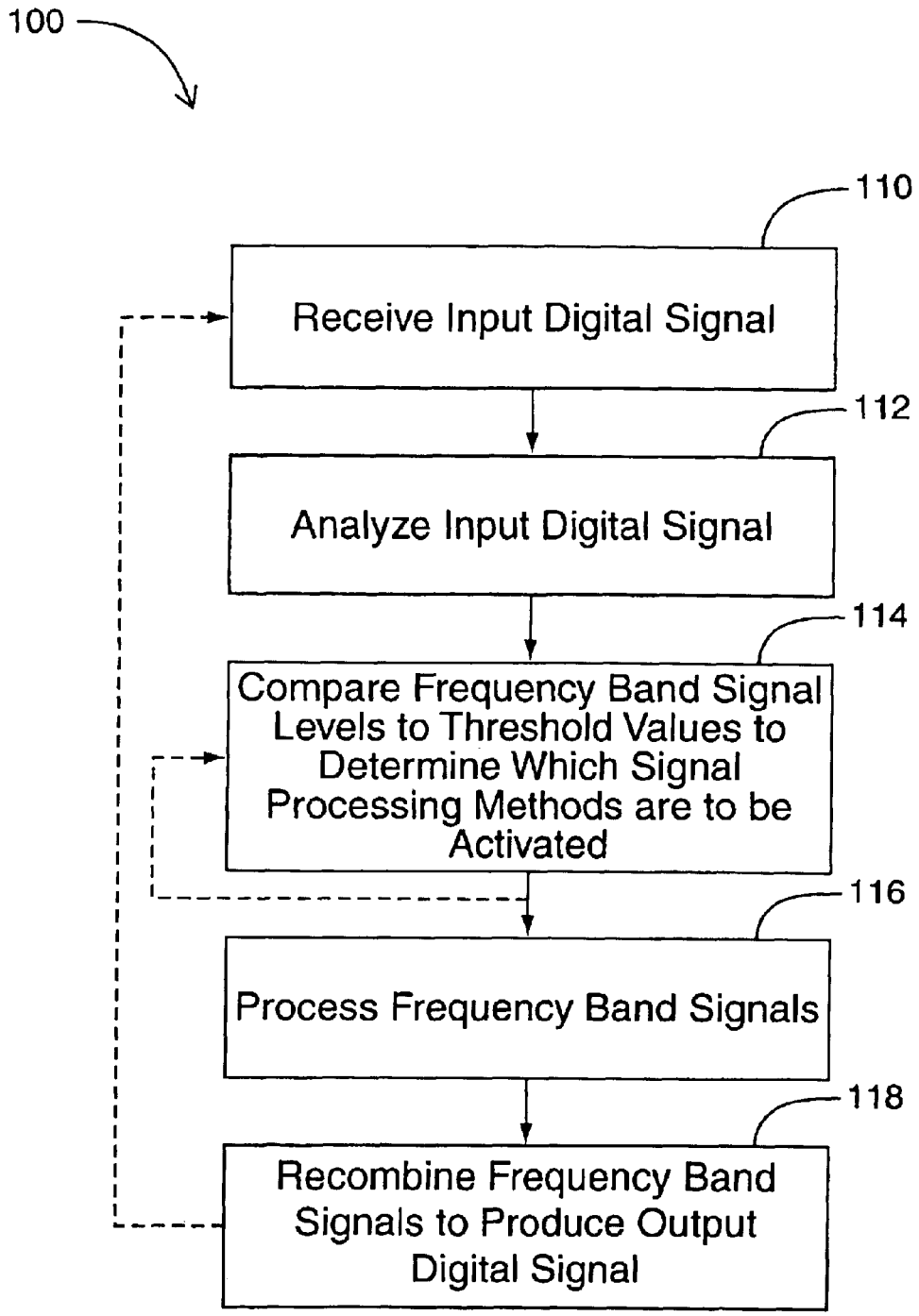
FIG. 5 is a flowchart illustrating steps in a process of adaptively processing signals in a hearing aid in accordance with an embodiment of the present invention.

Referring to FIG. 5, a flowchart illustrating steps in a process of adaptively processing signals in a hearing aid in accordance with an embodiment of the present invention is shown generally as 100.

The steps of process 100 are repeated continuously, as successive samples of sound are obtained by the hearing aid for processing.

an input digital signal is received by the processing core (e.g. core 26 of FIG. 1). In this embodiment of the invention, the input digital signal is a digital signal converted from an input acoustic signal by an analog-to-digital converter (e.g. ADC 24*a*of FIG. 1). The input acoustic signal is obtained from one or more microphones (e.g. microphone 20 of FIG. 1) adapted to receive sound for the hearing aid.

At step 112, the input digital signal received at step 110 is analyzed. At this step, the input digital signal received at step 110 is separated into, for example, 16 500 Hz wide frequency band signals using a transform technique, such as a Fast Fourier Transform, for example. The level of each frequency band signal can then be determined. In this embodiment, the level computed is an average loudness (in dB SPL) in each band. It will be understood by persons skilled in the art that the number of frequency band signals obtained at this step and the width of each frequency band may differ in variant implementations of the invention.

Optionally, at step 112, the input digital signal may be analyzed to determine the overall level across all frequency bands (broadband). This measurement may be used in subsequent steps to activate signal processing methods that are not band dependent, for example.

Alternatively, at step 112, the overall level may be calculated before the level of each frequency band signal is determined. If the overall level of the input digital signal has not attained the overall level of the LTASS from which a given set of threshold values are derived, then the level of each frequency band signal is not determined at step 112. This may optimize processing performance, as the level of each frequency band signal is not likely to exceed a threshold value for a given frequency band when the overall level of the LTASS from which the threshold value is derived has not yet been exceeded. Therefore, it is generally more efficient to defer the measurement of the band-specific levels of the input signal until the overall LTASS level is attained.

At step 114, the level of each frequency band signal determined at step 112 is compared with a corresponding threshold value from a set of threshold values, for a band-dependent signal processing method. For a signal processing method that can be applied in different processing modes depending on the input signal (e.g. directional microphone), the level of each frequency band signal is compared with corresponding threshold values from multiple sets of threshold values, each set of threshold values being associated with a different processing mode of the signal processing method. In this case, by comparing the level of each frequency band signal to the different threshold values (which may define discrete ranges for each processing mode), the specific processing mode of the signal processing method that should be applied to the frequency band signal can be determined.

In this embodiment of the invention, step 114 is repeated for each band-dependent signal processing method.

At step 116, each frequency band signal is processed according to the determinations made at step 114. Each band-dependent signal processing method is applied in the appropriate processing mode to each frequency band signal.

If a particular signal processing method to be applied (or the specific mode of that signal processing method) is different from the signal processing method (or mode) most recently applied to the input signal in that frequency band in a previous iteration of the steps of process 100, it will be necessary to switch between signal processing methods (or modes). The hearing aid may be adapted to allow fitters or users of the hearing aid to select an appropriate transition scheme, in which schemes that provide for perceptually slow transitions to fast transitions can be chosen depending on user preference or need.

A slow transition scheme is one in which the switching between successive processing methods in response to varying input levels for "quiet" and "noisy" environments is very smooth and gradual. For example, the adaptive microphone directionality and adaptive noise cancellation signal processing methods will seem to work very smoothly and consistently when successive processing methods are applied according to a slow transition scheme.

In contrast, a fast transition scheme is one in which the switching between successive processing methods in response to varying input levels for "quiet" and "noisy" environments is almost instantaneous.

Different transition schemes within a range between two extremes (e.g. "very slow" and "very fast") may be provided in variant implementations of the invention.

It is evident that threshold levels for specific signal processing modes or methods can be based on band levels, broadband levels, or both.

In one embodiment of the present invention, a selected number of frequency bands may be designated as a "master" group. As soon as the level of the frequency band signals in the master group exceed their corresponding threshold values associated with a new processing mode or signal processing method, the frequency band signals of all frequency bands can be switched automatically to the new mode or signal processing method (e.g. all bands switch to directional). In this embodiment, the level of the frequency band signals in all master bands would need to have attained their corresponding threshold values to cause a switch in all bands. Alternatively, one average level over all bands of the master group may be calculated, and compared to a threshold value defined for that master group.

As an example, a fast way to switch all bands from an omni-directional mode to a directional mode is to make every frequency band a separate master band. As soon as the level of the frequency band signal of one band is higher than its corresponding threshold value associated with a directional processing mode, all bands will switch to directional processing. Alternate implementations to vary the switching speed are possible, depending on the particular signal processing method, user need, or speed of environmental changes, for example.

It will also be understood by persons skilled in the art, that the master bands need not cause a switch in all bands, but instead may only control a certain group of bands. There are many ways to group bands to vary the switching speed. The optimum method can be determined with subjective listening tests.

At step 118, the frequency band signals processed at step 116 are recombined by applying an inverse transform (e.g. an inverse Fast Fourier Transform) to produce a digital signal. This digital signal can be output to a user of the hearing aid after conversion to an analog, acoustic signal (e.g. via DAC 38 and receiver 40), or may be subject to further processing. For example, additional signal processing methods (e.g. non band-based signal processing methods) can be applied to the recombined digital signal. Determinations may also be made before a particular additional signal processing methods is applied, by comparing the overall level of the output digital signal (or of the input digital signal if performed earlier in process 100) to a pre-defined threshold value associated with the respective signal processing method, for example.

Where decisions to use particular signal processing methods are made solely based on average input levels without considering signal amplitude modulations in frequency bands, this can lead to incorrect distinctions between loud speech and loud music. When using the telephone in particular, the hearing aid receives a relatively high input level, typically in excess of 65 dB DPL, and generally with a low noise component. In these cases, it is generally disadvantageous to activate a directional microphone when little or no noise is present in the listening environment. Accordingly, in variant embodiments of the invention, process 100 will also comprise a step of computing the degree of signal amplitude fluctuation or modulation in each frequency band to aid in the determination of whether a particular signal processing method should be applied to a particular frequency band signal.

For example, determination of the amplitude modulation in each band can be performed by the signal classification part of an adaptive noise reduction algorithm. An example of such a noise reduction algorithm is described in U.S. patent application Ser. No. 10/101,598, in which a measure of amplitude modulation is defined as "intensity change". A determination of whether the amplitude modulation can be characterized as "low", "medium", or "high" is made, and used in conjunction with the average input level to determine the appropriate signal processing methods to be applied to an input digital signal. Accordingly, Table 2 may be used as a partial decision table to determine the appropriate signal processing methods for a number of common listening environments. Specific values used to characterize whether the amplitude modulation can be categorized as "low", "medium", or "high" can be determined empirically for a given implementation. Different categorizations of amplitude modulation may be employed in variant embodiments of the invention.

In variant embodiments of the invention, a broadband measure of amplitude modulation may be used in determining whether a particular signal processing method should be applied to an input signal.

In variant embodiments of the invention, process 100 will also comprise a step of using a signal index, which is a parameter derived from the algorithm used to apply adaptive noise reduction. Using the signal index can provide better results, since it is not only derived from a measure of amplitude modulation of a signal, but also on the modulation frequency and time duration of the signal. As described in U.S. patent application Ser. No. 10/101,598, the signal index is used to classify signals as desirable or noise. A high signal index means the input signal is comprised primarily of speech-like or music-like signals with comparatively low levels of noise.

The use of a more comprehensive measure such as the signal index, computed in each band, in conjunction with the average input level in each band, to determine which modes of which signal processing methods should be applied in process 100 can provide more desirable results. For example, Table 3 below illustrates a decision table that may be used to determine when different modes of the adaptive microphone directionality and adaptive noise cancellation signal processing methods should be applied in variant embodiments of the invention. In one embodiment of the invention, the average level is band-based, with "high", "moderate"and "low", corresponding to three different LTASS levels respectively. Specific values used to characterize whether the signal index has a value of "low", "medium", or "high" can be determined empirically for a given implementation.

TABLE 3

Use of signal index and average level to determine appropriate processing modes

| | Signal Index | | |
|---|---|---|---|
| | High | Medium | Low |
| Average Level (dB SPL) | | | |
| High | Omni | NC-medium Directional 2 | NC-strong Directional 2 |
| Moderate | Omni | NC-soft Directional 1 | NC-moderate Directional 1 |
| Low | Omni | Omni | NC-soft Omni |

In variant embodiments of the invention, a broadband value of the signal index may be used in determining whether a particular signal processing method should be applied to an input signal. It will also be understood by persons skilled in the art that the signal index may also be used in isolation to determine whether specific signal processing methods should be applied to an input signal.

In variant embodiments of the invention, the hearing aid may be adapted with at least one manual activation level control, which the user can operate to control the levels at which the various signal processing methods are applied or activated within the hearing aid. In such embodiments, switching between various signal processing methods and modes may still be performed automatically within the hearing aid, but the sets of threshold values for one or more selected signal processing methods are moved higher or lower (e.g. in terms of average signal level) as directed by the user through the manual activation level control(s). This allows the user to adapt the given methods to conditions not anticipated by the hearing aid or to fine-tune the hearing aid to better adapt to his or her personal preferences. Furthermore, as indicated above with reference to FIG. 5, the hearing aid may also be adapted with a transition control that can be used to change the transition scheme, to be more or less aggressive.

Each of these activation level and transition controls may be provided as traditional volume control wheels, slider controls, push button controls, a user-operated wireless remote control, other known controls, or a combination of these.

The present invention has been described with reference to particular embodiments. However, it will be understood by persons skilled in the art that a number of other variations and modifications are possible without departing from the scope of the invention.

What is claimed is:

1. A process for adaptively processing signals in a hearing aid to improve perception of desired sounds by a user thereof, wherein the hearing aid is adapted to apply one or more of a predefined plurality of signal processing methods to the signals, the process comprising the steps of:

a) receiving an input digital signal, wherein the input digital signal is derived from an input acoustic signal converted from sounds received by the hearing aid;

b) analyzing the input digital signal, wherein at least one level and at least one measure of amplitude modulation is determined from the input digital signal;

c) for each of the plurality of signal processing methods, determining if the respective signal processing method is to be applied to the input digital signal at step d) by performing the substeps of (i) comparing each level determined at step b) with at least one first threshold value defined for the respective signal processing method, and (ii) comparing each measure of amplitude modulation determined at step b) with at least one second threshold value defined for the respective signal processing method; and d) processing the input digital signal to produce an output digital signal, wherein the processing step comprises applying each signal processing method to the input digital signal as determined at step c).

2. The process of claim 1, wherein the predefined plurality of signal processing methods comprises the following signal processing methods: adaptive microphone directionality, adaptive noise reduction, adaptive real-time feedback cancellation, and adaptive wind noise management.

3. The process of claim 1, wherein step b) comprises determining a broadband, average level of the input digital signal.

4. The process of claim 1, wherein step b) comprises separating the input digital signal into a plurality of frequency band signals and determining a level for each frequency band signal.

5. The process of claim 4, wherein at least one plurality of first threshold values is defined for each of a subset of the plurality of signal processing methods, wherein each plurality of first threshold values is associated with a processing mode of the respective signal processing method of the subset, and wherein substep (i) of step c) includes: for each signal processing method of the subset, comparing the level for each frequency band signal with a corresponding first threshold value from each plurality of first threshold values defined for the respective signal processing method, in determining if the respective signal processing method is to be applied to the input digital signal in a respective processing mode thereof.

6. The process of claim 5, wherein step d) comprises applying each signal processing method of the subset to the frequency band signals of the input digital signal as determined at step c), and recombining the frequency band signals to produce the output digital signal.

7. The process of claim 5, wherein for each frequency band signal, adaptive microphone directionality can be applied thereto in one of three processing modes comprising an omni-directional mode, a first directional mode, and a second directional mode.

8. The process of claim 5, wherein for each frequency band signal, adaptive wind noise management processing can be applied thereto, wherein adaptive noise reduction is applied to the respective frequency band signal when low level wind noise is detected therein, and wherein adaptive maximum output reduction is applied to frequency band signals when high level wind noise is detected therein.

9. The process of claim 5, wherein at least one plurality of first threshold values for each signal processing method of the subset is derived from a speech-shaped spectrum.

10. The process of claim 1, wherein step b) comprises determining a broadband measure of amplitude modulation from the input digital signal.

11. The process of claim 1, wherein step b) comprises separating the input digital signal into a plurality of frequency band signals and determining a measure of amplitude modulation for each frequency band signal.

12. The process of claim 11, wherein at least one plurality of second threshold values is defined for each of a subset of the plurality of signal processing methods, wherein each plurality of second threshold values is associated with a processing mode of the respective signal processing method of the subset, and wherein substep (ii) of step c) comprises: for each signal processing method of the subset, comparing the measure of amplitude fluctuation for each frequency band signal with a corresponding second threshold value from each plurality of second threshold values defined for the respective signal processing method, in determining if the respective signal processing method is to be applied to the input digital signal in a respective processing mode thereof.

13. The process of claim 12, wherein at least one plurality of second threshold values for each signal processing method of the subset is derived from a speech-shaped spectrum.

14. The process of claim 1, further comprising the step of modifying the at least one first threshold value using input received from the user.

15. The process of claim 1, further comprising the step of modifying the at least one second threshold value using input received from the user.

16. The process of claim 1, wherein the applying of each signal processing method to the input digital signal at step d)

is performed in accordance with a transition scheme selected from the following group: hard switching; and soft switching.

17. A digital hearing aid comprising a processing core programmed to perform the steps of the process of claim 1.

18. A process for adaptively processing signals in a hearing aid to improve perception of desired sounds by a user thereof, wherein the hearing aid is adapted to apply one or more of a predefined plurality of signal processing methods to the signals, the process comprising the steps of:

a) receiving an input digital signal, wherein the input digital signal is derived from an input acoustic signal converted from sounds received by the hearing aid;

b) analyzing the input digital signal, wherein at least one level and at least one signal index value is determined from the input digital signal;

c) for each of the plurality of signal processing methods, determining if the respective signal processing method is to be applied to the input digital signal at step d) by performing the substeps of (i) comparing each level determined at step b) with at least one first threshold value defined for the respective signal processing method, and (ii) comparing each signal index value determined at step b) with at least one second threshold value defined for the respective signal processing method; and d) processing the input digital signal to produce an output digital signal, wherein the processing step comprises applying each signal processing method to the input digital signal as determined at step c).

19. The process of claim 18, wherein each signal index value is derived from one or more measures of amplitude modulation, modulation frequency, and time duration derived from the input digital signal.

20. The process of claim 18, wherein the predefined plurality of signal processing methods comprises the following signal processing methods: adaptive microphone directionality, adaptive noise reduction, adaptive real-time feedback cancellation, and adaptive wind noise management.

21. The process of claim 18, wherein step b) comprises determining a broadband, average level of the input digital signal.

22. The process of claim 18, wherein step b) comprises separating the input digital signal into a plurality of frequency band signals and determining a level for each frequency band signal.

23. The process of claim 22, wherein at least one plurality of first threshold values is defined for each of a subset of the plurality of signal processing methods, wherein each plurality of first threshold values is associated with a processing mode of the respective signal processing method of the subset, and wherein substep (i) of step c) includes: for each signal processing method of the subset, comparing the level for each frequency band signal with a corresponding first threshold value from each plurality of first threshold values defined for the respective signal processing method, in determining if the respective signal processing method is to be applied to the input digital signal in a respective processing mode thereof.

24. The process of claim 23, wherein step d) comprises applying each signal processing method of the subset to the frequency band signals of the input digital signal as determined at step c), and recombining the frequency band signals to produce the output digital signal.

25. The process of claim 23, wherein for each frequency band signal, adaptive microphone directionality can be applied thereto in one of three processing modes comprising an omni-directional mode, a first directional mode, and a second directional mode.

26. The process of claim 23, wherein for each frequency band signal, adaptive wind noise management processing can be applied thereto, wherein adaptive noise reduction is applied to the respective frequency band signal when low level wind noise is detected therein, and wherein adaptive maximum output reduction is applied to the respective frequency band signal when high level wind noise is detected therein.

27. The process of claim 23, wherein at least one plurality of first threshold values for each signal processing method of the subset is derived from a speech-shaped spectrum.

28. The process of claim 18, wherein step b) comprises determining a broadband signal index value from the input digital signal.

29. The process of claim 18, wherein step b) comprises separating the input digital signal into a plurality of frequency band signals and determining a signal index value for each frequency band signal.

30. The process of claim 29, wherein at least one plurality of second threshold values is defined for each of a subset of the plurality of signal processing methods, wherein each plurality of second threshold values is associated with a processing mode of the respective signal processing method of the subset, and wherein substep (ii) of step c) comprises: for each signal processing method of the subset, comparing the signal index value for each frequency band signal with a corresponding second threshold value from each plurality of second threshold values defined for the respective signal processing method, in determining if the respective signal processing method is to be applied to the input digital signal in a respective processing mode thereof.

31. The process of claim 30, wherein at least one plurality of second threshold values for each signal processing method of the subset is derived from a speech-shaped spectrum.

32. The process of claim 18, further comprising the step of modifying the at least one first threshold value using input received from the user.

33. The process of claim 18, further comprising the step of modifying the at least one second threshold value using input received from the user.

34. The process of claim 18, wherein the applying of each signal processing method to the input digital signal at step d) is performed in accordance with a transition scheme selected from the following group: hard switching; and soft switching.

35. A digital hearing aid comprising a processing core programmed to perform the steps of the process of claim 18.

36. A process for adaptively processing signals in a hearing aid to improve perception of desired sounds by a user thereof, wherein the hearing aid is adapted to apply one or more of a predefined plurality of signal processing methods to the signals, the process comprising the steps of:

a) receiving an input digital signal, wherein the input digital signal is derived from an input acoustic signal converted from sounds received by the hearing aid;

b) analyzing the input digital signal, wherein the input digital signal is separated into a plurality of frequency band signals, and wherein a level for each frequency band signal is determined;

c) for each of a subset of said plurality of signal processing methods, comparing the level for each frequency band signal with a corresponding threshold value from each of at least one plurality of threshold values defined for the respective signal processing method of the subset, wherein each plurality of threshold values is associated with a processing mode of the respective signal processing method of the subset, to determine if the respective signal processing method is to be applied to the input digital signal in a respective processing mode thereof at step d); and d) processing the input digital signal to produce an output digital signal, wherein the processing step comprises applying each signal processing method of the subset to the frequency band signals of the input digital signal as determined at step c), and recombining the frequency band signals to produce the output digital signal.

37. The process of claim 36, further comprising an additional step of determining whether additional signal processing methods not in said subset are to be applied to the digital signal at step d), and wherein the processing step further comprises applying each additional signal processing method not in said subset to the input digital signal as determined at said additional step.

38. The process of claim 36, wherein the predefined plurality of signal processing methods comprises the following signal processing methods: adaptive microphone directionality, adaptive noise reduction, adaptive real-time feedback cancellation, and adaptive wind noise management.

39. The process of claim 36, wherein for each frequency band signal, adaptive microphone directionality can be applied thereto in one of three processing modes comprising an omni-directional mode, a first directional mode, and a second directional mode.

40. The process of claim 36, wherein for each frequency band signal, adaptive wind noise management processing can be applied thereto, wherein adaptive noise reduction is applied to the respective frequency band signal when low level wind noise is detected therein, and wherein adaptive maximum output reduction is applied to the respective frequency band signals when high level wind noise is detected therein.

41. The process of claim 36, further comprising determining a broadband, average level of the input digital signal, to be used as an additional threshold value for determining whether one or more of the signal processing methods in the subset are to be applied in the processing step.

42. The process of claim 36, wherein the plurality of threshold values for each signal processing method of the subset is derived from a speech-shaped spectrum.

43. The process of claim 36, further comprising the step of modifying the at least one first threshold value using input received from the user.

44. The process of claim 36, further comprising the step of modifying the at least one second threshold value using input received from the user.

45. The process of claim 36, wherein the applying of each signal processing method to the input digital signal at step d) is performed in accordance with a transition scheme selected from the following group: hard switching; and soft switching.

46. A digital hearing aid comprising a processing core programmed to perform the steps of the process of claim 36.

* * * * *

UNITED STATES PATENT AND TRADEMARK OFFICE

CERTIFICATE OF CORRECTION

PATENT NO. : 6,912,289 B2
DATED : June 28, 2005
INVENTOR(S) : Vonlanthen et al.

It is certified that error appears in the above-identified patent and that said Letters Patent is hereby corrected as shown below:

Column 3,
Line 13, delete “frequency,band” and insert -- frequency band --.

Column 13,
Line 50, before “an input digital signal”, insert -- At step 110 --.

Signed and Sealed this

Twenty-seventh Day of September, 2005

JON W. DUDAS
*Director of the United States Patent and Trademark Office*